United States Patent [19]

Green

[11] 4,079,476

[45] Mar. 21, 1978

[54] FIBERGLASS FOOTBRIDGE

[75] Inventor: Andrew Green, Fort Worth, Tex.

[73] Assignee: Composite Technology, Inc., Fort Worth, Tex.

[21] Appl. No.: 814,273

[22] Filed: Jul. 11, 1977

[51] Int. Cl.[2] ..... E01D 1/00

[52] U.S. Cl. ..... 14/69.5; 14/17

[58] Field of Search ..... 14/69.5, 2, 2.4, 2.6, 14/1, 17; 182/46; 52/309.16

[56] References Cited

U.S. PATENT DOCUMENTS

| | | | |
|---|---|---|---|
| 2,367,291 | 1/1945 | Le Tourneau | 14/1 |
| 3,169,602 | 2/1965 | Myers | 182/46 |
| 3,328,818 | 7/1967 | Melcher | 52/309.16 X |
| 3,350,497 | 10/1967 | Weaver | 14/69.5 X |
| 3,476,338 | 11/1969 | Fisher | 14/69.5 X |
| 3,591,437 | 7/1971 | Schafer | 52/309.16 X |
| 4,029,172 | 6/1977 | Green | 182/46 |

*Primary Examiner*—Nile C. Byers
*Attorney, Agent, or Firm*—Robert A. Felsman

[57] ABSTRACT

A fiberglass footbridge comprising a floor, handrails, and a web between the floor and the handrails, all of fiberglass. A continuous layer of fiberglass filaments that extend parallel with the bridge are formed in the handrails and the corners of the floor. U-shaped supporting members are attached around the web and the floor, and are spaced between the ends of the bridge. A subfloor or torque box is formed between the supporting members below the floor.

6 Claims, 3 Drawing Figures

Fig. 2
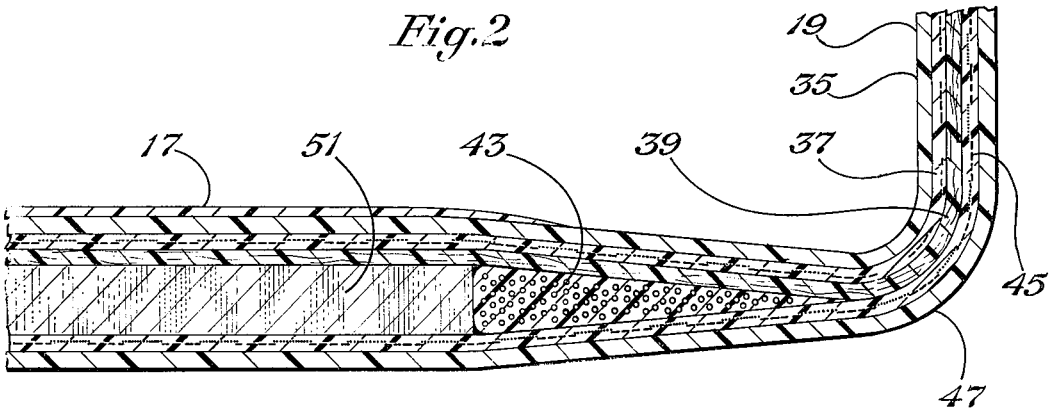
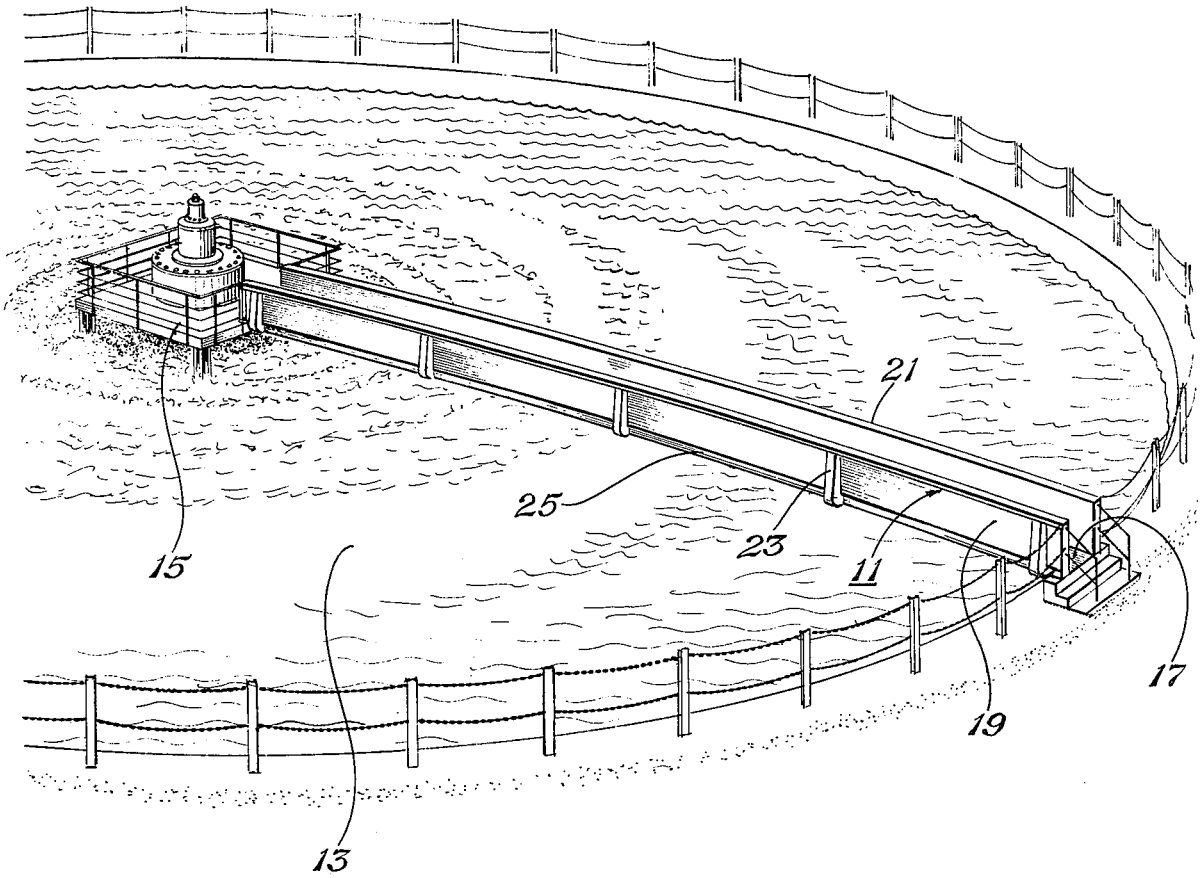
Fig. 3

FIBERGLASS FOOTBRIDGE

BACKGROUND OF THE INVENTION

1. Field of the Invention

This invention relates in general to footbridges and in particular to a footbridge formed of fiberglass.

2. Description of the Prior Art

There is a need for corrosion resistant footbridges and walkways in locations with highly corrosive atmospheres. For example in waste water treatment facilities, large tanks or ponds containing water being treated require footbridges to reach pumping equipment located in the center of the ponds. These footbridges may be as long as 70 feet or more, and are normally suspended only at the ends. They are normally constructed of steel, and even though coated with a protective coating, may last only six years because of the highly corrosive environment.

Fiberglass structures are used for many purposes and are known to be resistant to corrosion. One limitation on their use for bridges results from the modulus of electricity for fiberglass, which is much lower than the modulus of electricity of steel. One may increase the rigidity of a fiberglass member by putting more fibers in it, but if one wishes to reach the rigidity of steel member, the expense may become prohibitive. Fiberglass footbridges, however, are known to applicant. These footbridges are constructed of individual members bolted or bolted and bonded together to resemble a steel bridge. In addition to the high expense, these bridges are not entirely satisfactory in performance because composites have poor resistance to bearing and also crush under the bolt causing premature failure in some cases.

Consequently, to be competitive with steel footbridges, a fiberglass footbridge should contain structure that provides strength and rigidity without requiring individual structural members of high modulus of electricity. It is known that continuous parallel filaments of fiberglass formed in a member along its length will increase the bending strength and stiffness of the member. The use of continuous filaments is shown in U.S. Pat. No. 4,029,172 entitled Fiberglass Ladder filed July 12, 1976, which discloses a fiberglass ladder, and in U.S. Pat. No. 3,328,818, which discloses a ramp for unloading trucks. The ladder is for use in vertical or near vertical conditions, thus not subject in the same degree to bending and rotating forces as a bridge. The ramp does not have either a high span to depth ratio or a high width to span ratio, thus is also not subject to the same degree of bending and rotating forces.

SUMMARY OF THE INVENTION

It is accordingly a general object of this invention to provide a footbridge with improved resistance to corrosion.

It is a further object of this invention to provide an improved footbridge constructed of fiberglass with integral construction.

In accordance with these objects, a footbridge is provided having integral fiberglass construction. A horizontal layer provides the floor for pedestrians. A pair of handrails are mounted above the floor and are connected to the floor by a solid web of fiberglass. Continuous fiberglass filaments are located at the sides of the floor and at the handrail to increase resistance to bending. Depending on the length, several U-shaped supporting members are mounted around the floor and web to provide rigidity. A torque box is mounted below the floor between the supporting member to increase its resistance to rotation and to raise the shear center, thus increasing its torsional stability and stiffness and reducing its natural period of vibration.

BRIEF DESCRIPTION OF THE DRAWINGS

FIG. 2 is an enlarged vertical cross sectional view of the lower right hand corner of the footbridge of FIG. 1.

FIG. 3 is a perspective view of the footbridge of FIG. 1.

DESCRIPTION OF THE PREFERRED EMBODIMENT

Figure 1:
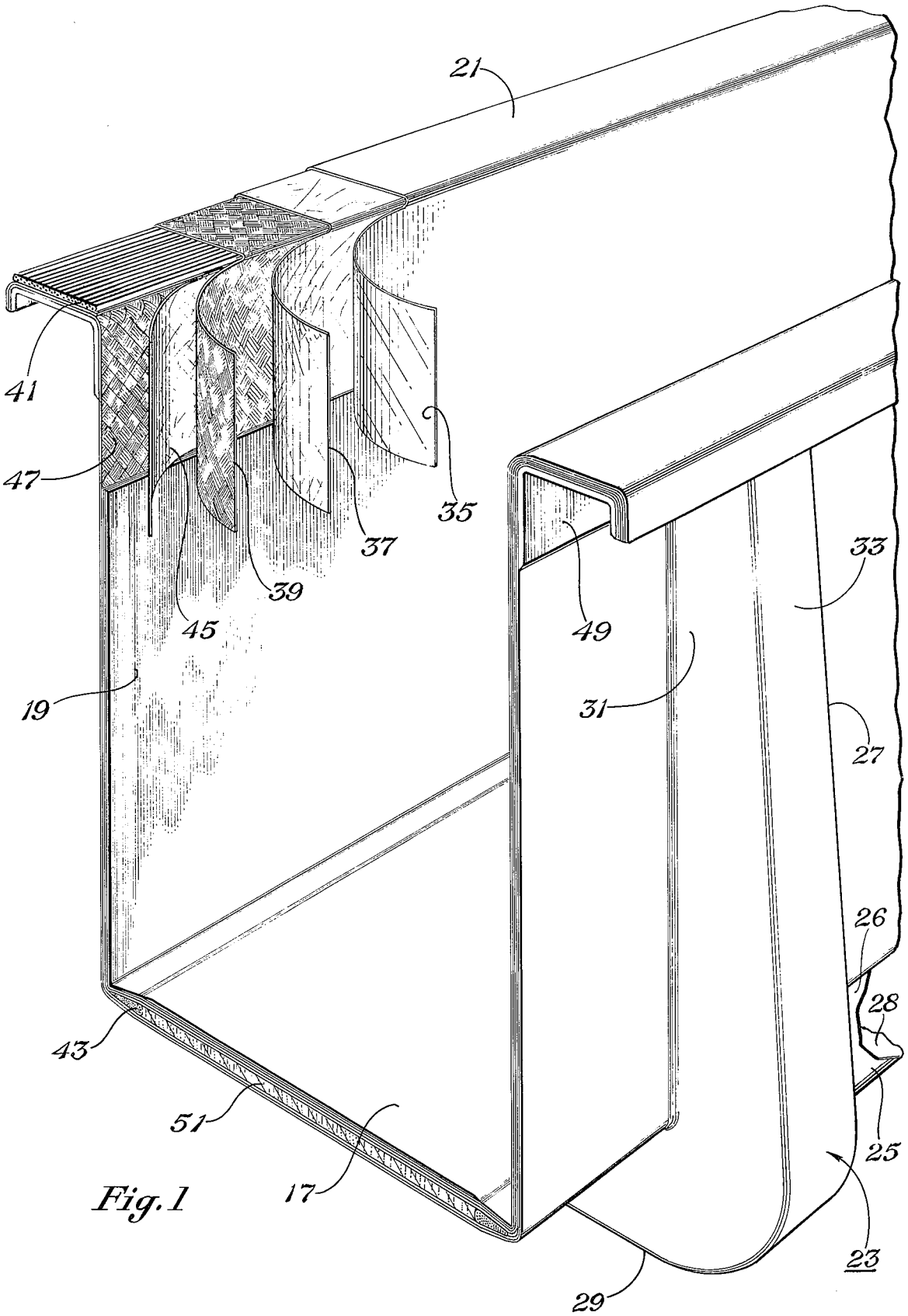
FIG. 1 is a fragmentary perspective view of a footbridge constructed in accordance with this invention.

Referring to FIG. 3, a footbridge 11 is shown mounted over a waste water treatment tank 13 between supports at the pumping station 15 and the edge of the tank. Referring also to FIG. 1, the footbridge is comprised of a horizontal floor 17, two sides or webs 19 extending vertically upward from the floor, and handrails 21 at the tops of the webs. The footbridge 11 thus resembles a rectangular channel member, with a closed bottom, sides perpendicular to the bottom, and flanges at the upper edges of the sides extending parallel with the bottom. Other structural members in the footbridge include U-shaped support members 23, and a subfloor or torque box 25 extending between the support members 23. The support members 23 are spaced preferably 17 feet apart and are required in footbridges greater than 20 feet in length. The torque box 25 is required in spans greater than 30 feet.

Each support member 23 has upwardly extending legs 27 joined together by a horizontal base 29. The legs 27 and base 29 are four-sided hollow beams, with two of the sides, designated as 31, parallel with each other and bonded normal to the exterior side of the webs 19 and the lower surface of the floor 17. The third side 33 of the support member 23 is parallel with the floor 17 at the base 29, and tapers inwardly toward the top on the legs 27. The fourth side of the beam is defined by the floor 17 and webs 19.

Torque box 25 is comprised of vertical flanges 26 bonded to webs 19 at the corner of the webs 19 with the floor 17, and a horizontal bottom or subfloor 28. Torque box 25 extends downwardly to a distance approximately the thickness of base 29 of support member 23. The vertical sides 26 of torque box 25 lie in the same plane as web 19, and the bottom 28 of torque box 25 is parallel with floor 17.

As shown in FIG. 1, the interior side of webs 19, floor 17, and the upper side of handrail 21 each have an outer skin or surface seal 35, which is a layer of resin, normally called gelcoat. The second layer or surface scrim 37 is of fiberglass mat. In this layer, the fiberglass pieces are short and randomly oriented. The surface scrim layer is optional, and serves to provide a smooth exterior and additional protection from deleterious chemicals. Other compositions may be suitable as well.

The third or shear reinforcing layer is of woven fiberglass, also known as woven roving. The shear reinforcing layer 39 has continuous fiberglass filaments grouped into a cross-hatched weave. Bands of these filaments are woven transverse to similar bands. In the preferred embodiment, all of the bands are preferably oriented 45° with respect to the length of the webs 19 and floor 17.

Directly below the shear reinforcing layer 39, a continuous layer 41 of unidirectional, individual fiberglass filaments extend parallel to the length or longitudinal axis of each handrail 21. Within the handrail 21, each filament is substantially parallel to each other and to the length of the handrail 21. The continuous filament layer 41 extends across the horizontal surface of handrail 21 and each individual filament extends the length of the bridge. Continuous filament layers 43 are also formed in the floor 17, preferably at the sides or corners of the floor 17 with the webs 19, as shown in FIG. 2.

Additional layers of mat fiberglass 45 and woven roving 47 are placed respectively on the other side of the continuous filament layers 41, 43.

Also layers 49 of fiberglass cloth, either mat or woven roving, are placed on the underside of handrail 21 for further stiffening. A layer 51 of balsa wood or other core material such as foam is placed between the continuous filament layers 43 in floor 17 on each side, and between the shear reinforcing layer 39 and mat fiberglass 45. The supporting members 23 are comprised of similar layers, including a layer of fiberglass filaments running the lengths of leg 27 and base 29.

The filaments in layers 41, 43 are pure fiberglass filaments that range in size from 35 to 40 × 10–5 inch. The number of individual filaments in layers 41, 43, depends on the length of the bridge. For a 70 foot bridge, 504 filaments are used on each handrail 21 and at each corner of the floor 17.

The fiberglass bridge 11 is constructed with a mold. The mold is channel-shaped with a top corresponding to floor 17, sides corresponding to webs 19, and horizontal flanges at the bottom of the sides corresponding to handrails 21. Initially a release agent is applied to the mold, then the gelcoat or surface seal 35 is sprayed over the mold. The surface scrim 37 and shear reinforcing 39 layers are placed over the mold. Then fiberglass filaments are pulled from spools and laid along the mold at the horizontal flanges and sides of the top. The layer 51 of wood is placed on the top between the layers 43 of continuous fiberglass filaments. Then layers 45 and 47 of mat and woven roving are placed over the mold. Curing is exothermic from a catalyst with the resin.

The supporting members 23 and torque box 25 are fabricated separately and bonded by conventional fiberglass techniques to the floor 17 and webs 19 after curing. The fiberglass bridge 11 is transported to the site and installed as a single integral piece by lifting in place and bolting to the two supports.

It is accordingly seen that an invention having significant improvements has been provided. The fiberglass bridge of this invention resists corrosion as it has no metal connections or joints. The strength provided by the filament reinforced handrail and floor, joined together by the webs 19, allows the bridge to carry normal loads with minimal flexing, particularly when combined with the support members 23 and torque box 25. Torque box 25 raises the shear center, minimizing the tendency to roll. Being of integral construction, the footbridge is less expensive to construct than footbridges having individual members joined together, and more satisfactory in performance.

While the invention has been shown in only one of its forms, it should be apparent to those skilled in the art that it is not so limited, but is susceptible to various changes and modifications without departing from the spirit thereof. For example, other nonmetallic filaments or fibers than fiberglass may be suitable for the continuous filaments, woven roving, and mat, such as carbon filaments and aromatic polyamide filaments.

I claim:

1. A footbridge suspended between a support at each end, comprising:

a horizontal layer of nonmetallic fibers connected between the supports to define a floor for pedestrians, with a continuous layer of nonmetallic filaments formed in the floor, each filament extending substantially parallel with the length of the floor;

a pair of nonmetallic fiber handrails spaced laterally apart and disposed above the floor, each handrail having a continuous layer of nonmetallic filaments extending substantially parallel with the length of the handrails; and two webs of nonmetallic fiber, each mounted perpendicular to the floor and connecting the floor with one of the handrails substantially along the length of the footbridge.

2. The footbridge according to claim 1 wherein the continuous filaments in the floor are disposed on each side of the floor adjacent its connection with the webs.

3. The footbridge according to claim 1, further comprising:

at least one U-shaped supporting member mounted to the footbridge intermediate its ends, the supporting member having upright legs connected to the exterior sides of the webs and a base connected to the lower surface of the floor.

4. The footbridge according to claim 3 wherein the footbridge contains at least two supporting members spaced apart along the length, with a subfloor mounted below the floor between supporting members.

5. The footbridge according to claim 1 wherein nonmetallic fibers in the floor, handrails, and webs comprise layers of woven fiberglass and layers of fiberglass mat, and wherein the continuous filaments are fiberglass filaments

6. A fiberglass footbridge suspended between a support at each end comprising:

a horizontal layer of fiberglass connected between the supports to define a floor for pedestrians, with a continuous layer of fiberglass filaments formed on each side edge of the floor and extending substantially parallel with the length of the floor;

a pair of fiberglass handrails spaced laterally apart and disposed above the floor, each handrail having a continuous layer of fiberglass filaments extending substantially parallel with the handrails;

two webs of fiberglass, each mounted perpendicular between the floor and one of the handrails and extending substantially the length of the footbridge;

a plurality of U-shaped supporting members spaced along the length of the foorbridge intermediate its ends, the supporting members having upright legs connected to the exterior sides of the webs and a base connected to the lower surface of the floor; and a subfloor mounted below the floor by vertical sides in the same plane and extending between the supporting members.

* * * * *